United States Patent [19]

Becdelievre et al.

[11] 4,072,485

[45] Feb. 7, 1978

[54] METHOD OF AND ARRANGEMENT FOR PROCESSING THROUGH LOW TEMPERATURE HEAT EXCHANGES AND IN PARTICULAR FOR TREATING NATURAL GASES AND CRACKED GASES

[75] Inventors: Charles Becdelievre, Maurepas; Victor Kaiser, Maisons Laffitte; Henri Paradowski, Rueil-Malmaison, all of France

[73] Assignee: Compagnie Francaise d'Etudes et de Construction - Technip, Rueil-Malmaison, France

[21] Appl. No.: 729,182

[22] Filed: Oct. 4, 1976

[30] Foreign Application Priority Data

Jan. 30, 1976 France ..... 76 02625

[51] Int. Cl.[2] ..... F25J 3/06

[52] U.S. Cl. ..... 62/23; 62/40

[58] Field of Search ..... 62/40, 9, 23, 114

[56] References Cited

U.S. PATENT DOCUMENTS

| | | | |
|---|---|---|---|
| 3,162,519 | 12/1964 | Peters et al. | 62/40 |
| 3,233,418 | 2/1966 | Shaievitz | 62/9 |
| 3,300,991 | 1/1917 | Carney | 62/40 |
| 3,616,652 | 11/1971 | Engel | 62/9 |
| 3,780,535 | 12/1973 | Darredeav | 62/40 |
| 3,818,714 | 6/1974 | Etzbach et al. | 62/40 |

*Primary Examiner*—Hiram H. Bernstein
*Attorney, Agent, or Firm*—Flynn & Frishauf

[57] ABSTRACT

A method of processing through low temperature heat exchanges natural gases and cracked gases consisting in using a cooling cycle including compressing and then cooling a cycle mixture of gases consisting of C1 hydrocarbons, C2 hydrocarbons and C3 hydrocarbons through outer coolers with attendant total liquefaction of the cycle mixture under pressure; subsequently effecting a sub-cooling of the mixture within heat exchanges in counter-current relation to one expanded part thereof and/or cold returns and rejects of products processed in the cycle and finally expanding said sub-cooled mixture in at least one exchanger where various cooling processes of the treated products are carried out at successive temperature levels.

16 Claims, 2 Drawing Figures

Figure 1:
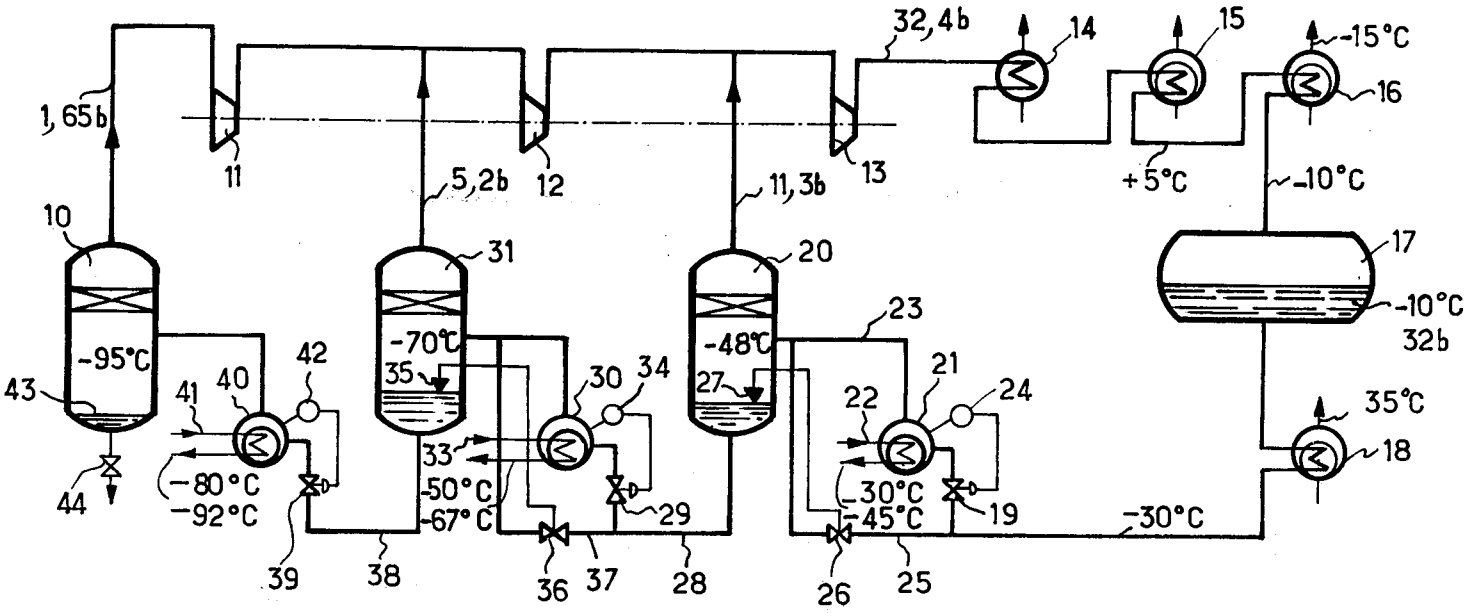

METHOD OF AND ARRANGEMENT FOR PROCESSING THROUGH LOW TEMPERATURE HEAT EXCHANGES AND IN PARTICULAR FOR TREATING NATURAL GASES AND CRACKED GASES

The present invention relates to a method of and an arrangement for processing through heat exchanges at low temperatures more particularly ranging between −30° C and −140° C, in particular for the purpose of purification or cleaning, fractional distillation and the treatment in general of natural gases and cracked gases.

Through such refrigerating treatments it is in particular possible after passing through suitable exchangers to obtain a separation in separators of fractions of the gas it is desired to separate. It is thus for instance known to "demethanize" a mixture of gases consisting essentially of hydrocarbons by separating the gaseous methane from the heavier hydrocarbons separated in the liquid state within a separator then referred to as a "demethanizer". Likewise it is possible to separate within an other separator ethylene and ethane from the heavier hydrocarbons, in particular from C3+-containing hydrocarbons, such a separator being then referred to as a "de-ethanizer". In such a separator ethylene is extracted in a gaseous condition at the head or top of the separator whereas ethane and the heavier hydrocarbons are separated in a liquid phase from ethylene.

Such treatment operating steps are well known and very effective with respect to separation and purity of the recovered products. Unfortunately the known ethylene-cycle refrigerating process used requires the use of complicated apparatus and the consumption of a large amount of power inherent in the cycle used.

The object of the present invention is to provide improvements to the cooling cycle used with a view to simplifying the apparatus, decreasing the power consumed for a same amount of treated products and therefore reducing the cost of the treatment.

The method of processing through heat exchangers at low temperatures more particularly ranging from −30° C to −140° C, in particular for the purpose of purification, fractional distillation and the treatment in general of natural gases, and cracked gases is characterized according to the invention in that it consists in making use of a cooling cycle comprising the compression and then the cooling of a cycle mixture of gases essentially comprising C1-containing, C2-containing and C3-containing hydrocarbons through outer coolants such for instance as water, air and propane down to about −30° C, −40° C, said cooling being attended by an at least partial liquefaction of said cycle mixture under pressure; then sub-cooling said mixture in heat exchangers in counter-current relation to one expanded part thereof and/or cold returns and rejects of products treated in the cycle; and finally expanding said sub-cooled mixture within at least one exchanger where the various treatments are carried out for cooling the process products at various successive temperature levels ranging from the lowest level for instance at about −100° C to −140° C to a less low level for instance at about −50° C to −30° C. With such a method the thermal efficiency of the exchanges is improved thereby making it possible to reduce the power consumed for every treated unit of products.

The arrangement enabling to carry out the method according to the invention is characterized in that it comprises :

a circuit of refrigerating fluid having several components consisting essentially of C1-containing, C2-containing and C3-containing hydrocarbons;

a station for compressing said fluid in the gaseous state from an absolute pressure of about 1 to 2 bars at the suction or intake side of the compressors up to an absolute pressure of 30 to 50 bars at the discharge or delievery side;

successive outer staged coolers working for instance with water, with air and with propane or propylene providing for the full condensation and/or the at least partial sub-cooling of said mixture after compression;

and at least one main exchanger where the expansion and vaporization of said cycle mixture down to the pressure of return flow to the compressors and the various heat exchanges for the cooling at the desired different temperature levels of the processed products are carried out.

Such an arrangement calls for a significantly simplified apparatus of more economical manufacture and maintenance.

Figure 2:
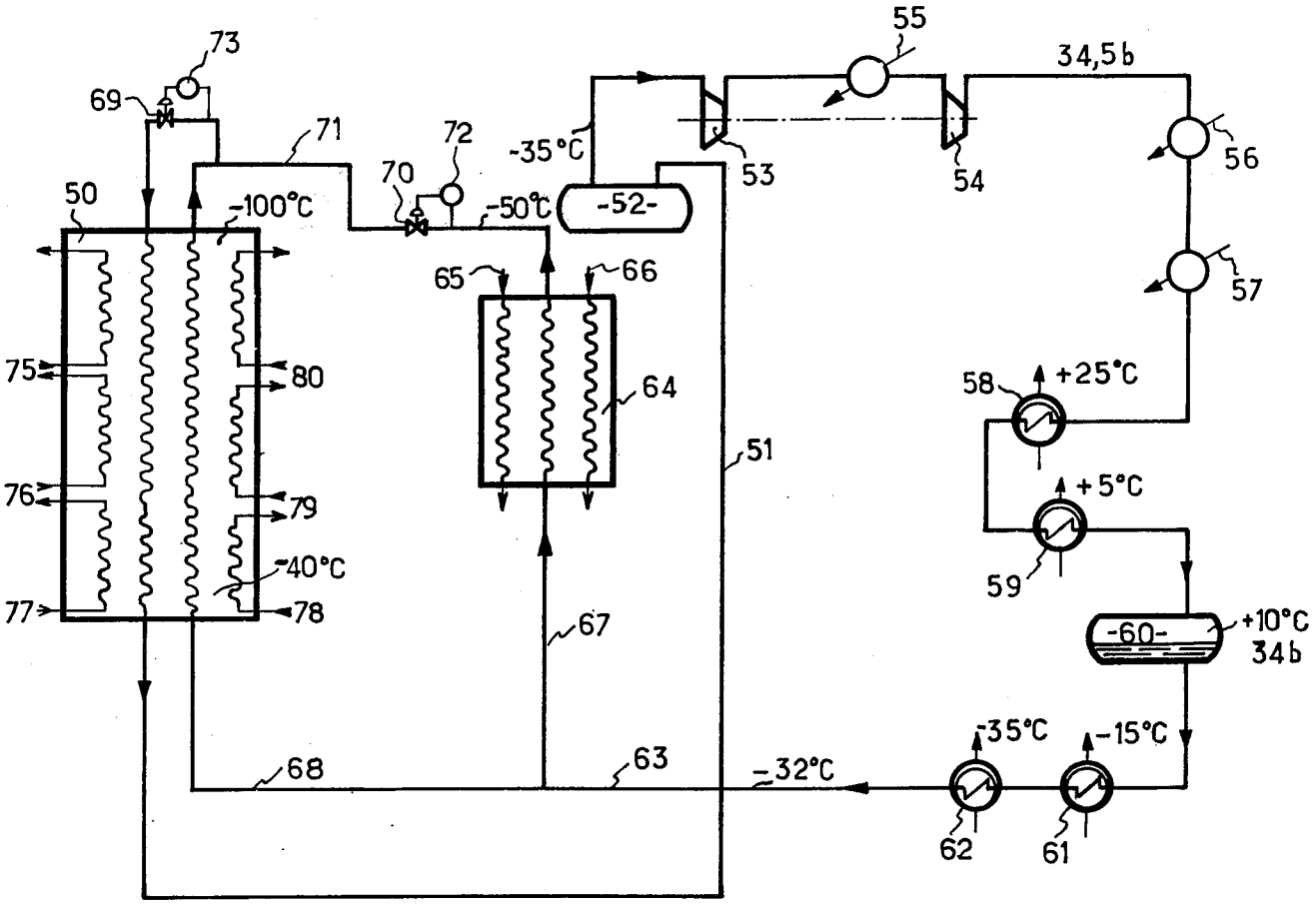

The invention will appear more clearly as the following description proceeds with reference to the accompanying drawings given by way of example only and wherein:

FIG. 1 shows a diagram for processing through refrigeration of conventional type; and FIG. 2 shows an improved diagram for treating through refrigeration according to the invention.

Reference should be made at first to FIG. 1 where there is illustrated an arrangement for treating cracked gases through staged coolings by liquefied ethylene and undergoing vaporization under three pressures stages according to three successive temperature levels.

In the example shown the cooling circuit makes use of ethylene as a cycle refrigerating gas. The gaseous ethylene issuing from separator 10 under an absolute pressure of 1.65 bars is compressed successively in low pressure stage 11, the medium pressure stage 12 and high pressure stage 13 of the compressors thereby bringing ethylene up to an absolute delivery pressure of 32.4 bars. The ethylene is thus cooled in a first water cooler 14 and then in two successive coolers 15, 16 operating for instance with propane, thereby making it possible to obtain liquid ethylene at about −10° C under 32 bars in the condenser tank 17. The ethylene is then sub-cooled to a lower temperature in an exchanger 18 working for instance with propylene or propane thereby bringing its temperature down to about −30° C.

The ethylene is then expended from the pressure of 32 bars through an expansion valve 19 down to the pressure of the separator 20 where it is of about 11.3 bars. This expansion provides the lowering of the temperature of ethylene in a boiler-exchanger 21 which making it possible to carry out a first refrigerating treatment at about −30° C, −45° C of products to be processed fed in at 22. These products may in particular be cracked gases, produced ethylene and as a general rule any charge it is desired to treat at such a temperature level. Ethylene which has been vaporized in the exchanger 21 is then carried through the duct 23 into the separator 20. The expansion valve 19 is operated by a level controller 24 which provides for the permanent proper operation of the boiler-exchanger 21. In order to control the liquid ethylene level at about −48° C in the separator 20 there is provided a by-pass duct 25 in which is mounted an expansion valve 26 controlled by a controller 27 for the liquid level in the separator 20.

The gaseous ethylene from the separator 20 flows back to the high pressure stage of the compressor 13, whereas the liquid ethylene is conveyed through the duct 28 towards an expansion valve 29 which feeds a second boiler-exchanger 30 subjected to the pressure from separator 31, namely 5.2 bars in the examplary embodiment shown.

This expansion makes it possible to obtain in boiler 30 a temperature level of the liquid ethylene of about −70° C thereby making it possible to treat the products fed in at 33 at a temperature level of about −50° C to −67° C. At 34 has been shown a controller for the level of liquid ethylene within the boiler 30 which automatically operates the expansion valve 29.

The level of liquid ethylene at −70° C within the separator 31 is controlled by a level controller 35 which actuates a valve 36 inserted in a by-pass circuit 36 in parallel relation to the valve 29 and the boiler-exchanger 30.

The gaseous ethylene flowing out from the separator 31 is drawn under a pressure of 5.2 bars into the inlet of the medium pressure stage 12 of the compressor, whereas the liquid ethylene at −70° C is conveyed through the duct 38 to the expansion valve 39 for feeding boiler-exchanger 40 at a lower temperature level of about −95° C in the examplary embodiment shown. In this exchanger 40 are processed the products fed in at 41 at temperature levels of about −80° C to −92° C. At 42 is shown a level controller for liquid ethylene within the exchanger 40 which controls the valve 39.

The ethylene issuing in the gaseous condition from the exchanger 40 is recovered or collected in the last separator 10 at a temperature of −95° C. The separator 10 performs the function of avoiding liquid being possibly carried along at the suction or input side of the compressor 11. The possible residual liquids 43 are recovered or collected at the bottom of the separator 10 and may possibly be withdrawn from time to time through a drain valve or bleed cock 44.

In addition to the relative complexity of the apparatus used, the arrangement described hereinabove exhibits specific drawbacks such in particular as:

A lack of flexibility in conducting the process operations, the temperature levels at the three exchanger stages 21, 30 and 40 being set essentially by the pressures prevailing within the respective separators 20, 31, 10, i.e. by the suction or input pressures at the three compression stages 11, 12, 13. Since with a given compressor the compression ratios are not variable, it is in practice not possible to modulate the processing temperature at the three exchangers 21, 30, 40, which therefore are not used under optimum conditions of thermodynamic exchanges.

In the cycle dipicted in FIG. 1 it is found that the outside cooling of the ethylene cycle is effected within the exchangers 14, 15, 16, 18. Taking into account the temperature levels it is found that, apart from the exchanger 14, it is in practice necessary to operate the exchangers 15, 16, 18 with a refrigerating fluid or coolant, for instance with a propane or propylene cycle, which accordingly should extract towards the outside a major portion of the heat extracted by the ethylene refrigerating cycle. This results in the requirement of providing a large refrigerating circuit working with propylene and requiring the use of a large compressor for the propylene cycle.

The diagram of an improved arrangement designed according to the invention is now described with reference to FIG. 2.

According to this diagram, there is provided a refrigerating circuit which does not make use of a pure substance such as ethylene but uses a mixture of gases more particularly comprising $C_1$-containing, $C_2$-containing and $C_3$-containing hydrocarbons and possibly $C_4$ and $N_2$. A suitable cycle mixture comprises for instance:

$C_1$: 7% to 12%
$C_2$: 30% to 45%
$C_3$: 50% to 60%.

Good results have been achieved with a cycle mixture of gases having the following composition:

$C_1$: 8%;
$C_2$: 37% to 42%;
$C_3$: 50% to 55%.

More generally and according to particular utilization requirements the cycle mixture can have a composition selected among the following value ranges:

$N_2$: 0% to 3%
$C_1$: 5% to 25%
$C_2$: 30% to 60%
$C_3$: 30% to 60%.

Other compositions of the cycle mixture which are especially well adapted to the cracking of liquid batches or charges in particular of naphtha gasolines (whereas the compositions referred to hereinabove preferably apply to the cracking of gaseous charges or batches) are the following:

$C_1$: 20% to 40%
$C_2$: 30% to 60%
$C_3$: 5% to 15%
$C_4$: 5% to 15%.

A specific example is:
methane: 30%
ethylene: 30%; ethane: 20%
propane: 10%
isobutane: 10%

Also suitable for the cracking of liquid charges or batches are the following compositions of cycle mixtures:

$N_2 > 0.5\%$
$C_1$: 20% to 40%
$C_2$: 30% to 60%
$C_3$: 20% to 35%.

A specific example is:
nitrogen: 1.5%
methane: 30%
ethylene: 20%; ethane: 20%
propane: 28.5%.

In the plant diagram shown this gaseous cycle mixture which has worked, i.e. extracted the heat required for the products processed within a main exchanger 50 is conveyed through a pipe-line 51 and a receiving storage tank 52 in a superheated gaseous condition at −35° C under 1.5 bars to the suction side of the first stage 53 of the compressors. The purpose of the receiving storage tank 52 is to avoid any possible liquid being carried along at the intake of the compressor 53 in case of a technical hitch or possible defect in operating the plant. In the examplary embodiment shown the cycle mixture is compressed within two successive compression stages 53, 54 separated by an outer intercooling 55 for instance by means of water.

The cycle mixture under a pressure of 34.5 bars which is the delivery pressure of the second compression stage 54 is then cooled within two successive outer coolers 56, 57 for instance by means of water or air. When issuing from the cooler 57 more than one half of the cycle mixture has already been condensed. The whole condensation of the cycle mixture is continued within two exchangers operating for instance on propane or propylene 58, 59 thereby making it possible to achieve the full condensation of the cycle mixture within the tank 60 at 10° C under 34 bars. Within this tank the gaseous cycle mixture has been fully liquefied.

The liquefied cycle mixture is then sub-cooled within two successive refrigerating stages 61, 62 working for instance with propane or propylene thereby bringing the temperature of the cycle mixture down to −32° C within the duct 63 before flowing through the main exchanger 50 and secondary exchanger 64. Although these sub-cooling stages are not indispensable they usually promote a flexible and economical operating control of the process.

The exchanger 64 receives at 65, 66 the cold rejects of any kind from the plant and for instance cold rejects between −40° C and −80° C of products treated within the main exchanger 50, for instance methane derived from a demethanizing step, etc. The exchanger 64 therefore makes it possible to recover one part of the energy expended to cool these rejects and to use the same for more thoroughly sub-cooling one part of the cycle mixture fed into the exchanger 64 through by-pass line 67. The sub-cooling temperature may for instance reach −50° C at the outlet of the exchanger 64.

The remainder of the cycle mixture which does not flow through the by-pass pipe-line 67 is fed through pipe-line 68 into the exchanger 50 in counter-current relationship with the cycle mixture entering the head or top of the exchanger 50 after expansion through the valve 69 which provides for the vaporization of the cycle mixture and hence the cooling of the exchanger 50. The fraction of the cycle mixture flowing through the pipe-line 68 is accordingly sub-cooled upon flowing through the exchanger 50 before entering the expansion valve 69.

At 70 is shown a valve for controlling the pressure of the sub-cooled cycle mixture having flown through the exchanger 64 and conveyed through the by-pass pipeline 71 to the expansion valve 69. At 72, 73 are shown devices for controlling the pressure control valve 70 and the expansion valve 69, respectively.

On account of the cycle mixture not being a pure substance, the expansion of such a mixture within the valve 69 will result within the exchanger 50 in the gradual vaporization the lightest fractions of the mixture being vaporized at first at the lowest temperatures and the less lighter fractions then being vaporized at a less lower temperature. Thereby, there is obtained within the exchanger 50 a temperature staging from the inlet for instance at about −100° C, to the outlet for instance at about −40° C. The exchanger 50 advantageously is of plate-type construction as well as the recovering exchanger 64.

The exchanger 50 lends itself easily to the positioning of various separated exchange circuits at differing temperature levels. In FIG. 2 are shown six exchange circuits corresponding to six possibilities of processing in parallel different products fed at 75, 76, 77, 78, 79 and 80, respectively, into the exchanger 50. The circuits 75, 80 are low-temperature circuits corresponding to some extent to the boiler 40 shown in FIG. 1. The circuits 76, 79 are medium-temperature level circuits corresponding to some extent to the boiler 30 shown in FIG. 1. The circuits 77 and 78 are circuits working at less lower temperatures corresponding somewhat to the boiler 21 illustrated in FIG. 1.

A comparison between both diagram of FIGS. 1 and 2 straightforwardly shows that an arrangement according to the invention is very much simplified in terms of apparatus as compared with the plant shown in FIG. 1.

Moreover, the diagram according to FIG. 2 makes it possible to achieve more flexibility in controlling the operations and running the plant because the level temperatures of the staged circuits within the exchanger 50 will automatically adjust themselves to the requirements which is not the case with the exchangers 21, 30, 40 shown in the diagram of FIG. 1.

Also the diagram according to FIG. 2 behave thermodynamically in a much more favorable manner than a plant according to the diagram of FIG. 1, thereby making it possible to achieve substantial power savings for providing the same refrigeration power.

On the other hand it appears from the diagram according to FIG. 2 that a great part of the condensation of the cycle mixture is provided by the outer coolers 56, 57 which may operate for instance by means of air or water, thereby making it possible to reduce to a large extent the power and size of the propane or propylene refrigeration cycle which provides for the full condensation and the first sub-cooling of the cycle mixture. In some cases it is possible to use one single air-operated or water-operated refrigeration cycle only for providing the full condensation of the cycle mixture within the drum 60.

It is at least apparent that by modifying the composition of the cycle mixture it is possible to alter or vary without affecting the apparatus the temperature and exchange conditions in particular at the exchanger 50 and therefore to best adapt such a composition to the requirements of the plant.

The figures corresponding to the temperatures and pressures shown in FIGS. 1 and 2 are given by way of example only and to facilitate comparisons, it being understood that with respect in particular to the diagram according to FIG. 2 the pressures and temperatures shown can vary to a rather substantial extent according to requirements. Thus a normal temperature range between the inlet and the outlet of the exchanger 50 would be between −140° C and −30° C.

More specifically, the suction during the compression step will generally be performed at an absolute pressure of between 1 bar and 3 bars, whereas the absolute discharge or delivery pressure will range from 30 to 50 bars. The temperature levels on the refrigerating fluid side of the exchanger 50 will usually range for the lowest level from −140° C to −100° C and for the less low level from −30° C to −50° C.

It should be understood that the invention is not at all limited to the form of embodiment and reduction to practice described which have been given by way of example only. The invention comprises all the technical equivalents of the means described as well as their combinations if the latter are carried out according to its gist and used within the scope of the appended claims.

What is claimed is:

1. In a method for refrigerating a natural gas or a cracked gas by indirect heat exchange with a cycle gas mixture at temperatures ranging from −40° C. to −140° C., the improvement comprising the sequence of steps compressing a cycle gas mixture consisting essentially of $C_1$, $C_2$ and $C_3$ hydrocarbons, cooling said compressed cycle gas mixture in a plurality of successive staged external, indirect heat exchanges with coolants selected from the group consisting of water, air, propane and propylene to about 40° C., whereby said cycle mixture is fully condensed, dividing the fully condensed cycle mixture into at least an auxiliary stream and a remaining stream, passing said auxiliary stream through an auxiliary heat exchanger countercurrently in indirect heat exchange with a colder stream employed in refrigerating the natural gas, whereby said auxiliary stream is sub-cooled, passing said remaining stream through a main heat exchanger countercurrently in indirect heat exchange with a combined liquefied sub-cooled cycle mixture as defined below after the latter has been expanded and passed into said main heat exchanger, whereby said remaining stream is sub-cooled, combining said sub-cooled auxiliary and remaining streams to form said combined liquefied sub-cooled cycle mixture, expanding said combined sub-cooled stream and passing it at a temperature of from about −100° C. to about −140° C. countercurrently into said main heat exchanger in indirect heat exchange with said remaining stream and with a warmer stream employed in refrigerating the natural gas.

2. A method according to claim 1, comprising the step of making said cycle mixture work between staged absolute pressures ranging from 1 bar to 3 bars at the suction side of the compressors and from 30 bars to 50 bars at the delivery side of the compressors.

3. A method according to claim 1, comprising the step of using as a cycle mixture a mixture comprising about 7% to 12% of $C_1$ hydrocarbon, 30% to 45% of $C_2$ hydrocarbons and 50% to 60% of $C_3$ hydrocarbons.

4. A method according to claim 3, wherein the cycle mixture is a mixture comprising about 8% of $C_1$ hydrocarbon, 37% to 42% of $C_2$ hydrocarbons and 50% to 55% of $C_3$ hydrocarbons.

5. A method according to claim 1, wherein the cycle mixture is a mixture comprising about:

$N_2$: 0% to 3%
$C_1$: 5% to 25%
$C_2$: 30% to 60%
$C_3$: 30% to 60%.

6. A method according to claim 1, wherein the cycle mixture is a mixture comprising:

$C_1$: 20% to 40%
$C_2$: 30% to 60%
$C_3$: 5% to 15%
$C_4$: 5% to 15%.

7. A method according to claim 6, wherein said cycle mixture has the following composition:

methane: 30%
ethylene: 30%; ethane: 20%
propane: 10%
isobutane: 10%.

8. A method according to claim 1, wherein the cycle mixture is a mixture having the following composition:

$N_2 > 0.5\%$
$C_1$: 20% to 40%
$C_2$: 30% to 60%
$C_3$: 20% to 35%.

9. A method according to claim 8, wherein said cycle mixture has the following composition:

nitrogen: 1.5%
methane: 30%
ethylene: 20%; ethane: 20%
propane: 28.5%.

10. A method according to claim 1, wherein said cycle mixture contains at least one of ethylene and propylene.

11. A system for refrigerating a natural gas or a cracked gas with a fluid cycle comprising multi-component refrigerant fluid at a low temperature of from −40° C. to −140° C., the multi-component refrigerant fluid consisting essentially of $C_1$, $C_2$ and $C_3$ hydrocarbons, the system comprising:

compression means for compressing said refrigerant fluid in the gaseous condition from an absolute pressure of about 1 bar to 3 bars at the suction side of the compression means to an absolute pressure of about 30 bars to 50 bars at the delivery side of the compression means;

successive stage external coolers coupled to said compression means and operating with coolants selected from the group consisting of water, air, propane and propylene for providing at least full condensation of said refrigerant fluid after compression;

at least one main heat exchanger coupled to at least one of said successive stage external cooler for receiving therefrom a first part of said condensed refrigerant fluid, and including inlet means and cold outlet means for said first part of said condensed refrigerant fluid, an expansion means at its cold end at a temperature of from about −100° C. to about −140° C. for expansion of said refrigerant fluid to the pressure at the suction side of the compression means, a vapor passage coupled to the expansion means for passing vaporized refrigerant fluid through the main exchanger for sub-cooling said first part of said condensed refrigerant fluid in indirect heat exchange therewith, and further inlet and further outlet means containing a warmer stream than said refrigerant vapor in indirect heat exchange relation with vapor in said exchanger;

at least one auxiliary heat exchanger having an inlet means and a cold outlet means, the inlet means thereof being coupled to said at least one of said successive stage external coolers for receiving a second part of said condensed refrigerant fluid, and having further inlet and further outlet means containing a colder stream than said second part of said condensed refrigerant fluid for sub-cooling said second part of said condensed refrigerant fluid;

means for coupling said vapor passage at its warm end to the suction side of said compression means; and a conduit connected to and joining the cold outlet means of said main and auxiliary heat exchangers for combining said sub-cooled first and second parts of said condensed refrigerant fluid, and connected to said expansion means.

12. A system according to claim 11, wherein at least one portion of said cycle mixture is liquefied after having flown through said outer coolers operating with at least one of water and air.

13. A system according to claim 11, wherein said main exchanger is used for sub-cooling at least one portion of said cycle mixture in counter-current relationship with itself prior to expansion and vaporization within said exchanger.

14. A system according to claim 11, further comprising a secondary exchanger for carrying out through heat exchange with cold process rejects issuing from said main exchanger the sub-cooling of at least one part of said cycle mixture before expansion and vaporization within said main exchanger.

15. A system according to claim 11, wherein said exchangers are of plate-type construction.

16. A system according to claim 15, wherein said main exchanger is divided on the refrigerated side into several independent components for the separate treatment of various products at given temperature levels.

* * * * *